US005771968A

United States Patent [19]

Danciger et al.

[11] Patent Number: 5,771,968

[45] Date of Patent: Jun. 30, 1998

[54] CABLE-BASED PUMPING SYSTEM

[76] Inventors: Edgar Danciger, 2919 Ponte Verde Blvd., Ponte Verde Beach, Fla. 32082; George W. Todd, 9229 Coral Cove, Dallas, Tex. 75243

[21] Appl. No.: 693,846

[22] Filed: Aug. 5, 1996

[51] Int. Cl.[6] ..... E21B 17/00; F04B 47/02

[52] U.S. Cl. ..... 166/68; 403/266; 403/279

[58] Field of Search ..... 166/68, 68.5, 72; 403/266, 267, 279, 281, 282, 370, 371

[56] References Cited

U.S. PATENT DOCUMENTS

| | | | |
|---|---|---|---|
| 3,889,579 | 6/1975 | Wiechowski et al. | 166/68 X |
| 4,024,913 | 5/1977 | Grable | 166/68 X |
| 4,475,839 | 10/1984 | Strandberg | 403/267 X |
| 4,592,421 | 6/1986 | Hoffman et al. | 166/68 X |
| 4,928,771 | 5/1990 | Vandevier | 166/68 X |

OTHER PUBLICATIONS

*Oil and Gas Journal*, Mobil Tests New Flexible Sucke–Rod System in Hugoton Field, Apr., 1974, pp. 76–85.

*Well Servicing*, "Ribbon Rods May Change Oil Industry" Jan./Feb., 1995, pp. 18–20.

*Primary Examiner*—David J. Bagnell

[57] ABSTRACT

A system for interconnecting a surface power source with a downhole pump in an oil well or similar fluid pumping installation uses a cable and associated connectors. The cable is constructed from a plurality of helically preformed wires which are heat treated and surrounded with a corrosion and abrasion resistant material. This construction provides the cable with sufficient stiffness that it does not slump, buckle or coil when inserted in the well, and with sufficient density that it is not buoyant in the fluid being pumped, but yet with sufficient flexibility that it can be unwound from a reel for insertion into the well and rewound on the reel for extraction from the well. The connectors, which are used at the ends of the cable, secure and protect the cable and allow easy adjustment of its length for optimum pump efficiency. The power consumption efficiency of the oil well is also enhanced since the cable is relatively lightweight and requires less energy to be raised and lowered during the pumping operation.

18 Claims, 2 Drawing Sheets

CABLE-BASED PUMPING SYSTEM

BACKGROUND OF THE INVENTION

1. Field of the Invention

The present invention relates generally to fluid pumping installations such as oil wells and, more particularly, to improvements in the mechanical interconnection between a surface power source and an underground pump in such wells. Even more particularly, the present invention is directed to replacing a series of sucker rods, pony rods, and even polished rods, and associated couplings, that have been previously used to form such mechanical interconnection, with a stiff but flexible cable which can be easily raised from or lowered into the well.

2. Related Prior Art Systems

The construction of a conventional pumping system for an oil well installation is commonly known in the art. Referring to FIG. 1, a typical prior art sucker-rod pumping system is shown to comprise, on the surface, a power source 10 including a pulley-and-belt combination driving a pitman 12 fastened to one end of a walking beam 14 having a curved horsehead 16 at the other end, and pivotally secured at its center to the top of an arched base 15. The horsehead 16 supports a wire line hanger 18 connected through a coupling 19 to a polished rod 20 extending downwardly through a packing assembly or stuffing box 22 and into a wellhead 24. A flowline 26 originating at the wellhead 24 provides an outlet for the fluid being pumped from an underground well, and the packing assembly 22 around the polished rod 20 prevents the fluid from escaping out of the top of the wellhead 24 and into the ground. Extending downwardly from the wellhead 24 and beneath the ground is a casing 28 containing a tubing 30 which houses a series of metallic sucker rods 32 and associated couplings 33 leading into a downhole (subsurface) pump 34 that includes a barrel 36, a plunger 38 and two ball valves, a standing valve 40 and a traveling valve (not shown) inside the plunger 38.

With continuing reference to FIG. 1, the sucker rods 32 interconnect the polished rod 20 above the surface with the plunger 38 in the subsurface pump 34. One or more pony rods (not shown) are usually connected between the sucker rods 32 and the polished rod 20. A typical pony rod is much shorter than a sucker rod (which is normally 25 feet long). Pony rods are used to adjust the total length of the mechanical interconnection between the horsehead 16 at the surface and the plunger 38 in the downhole pump 34 so as to maximize pumping efficiency while not allowing the plunger 38 to hit either the top or the bottom of the cavity within the pump 34.

Still referring to FIG. 1, the pump 34 operates on the positive displacement principle of a cylinder-and-piston combination with the barrel 36 acting as the stationary cylinder and the plunger 38 acting as the moving piston. The barrel 36 is fixedly connected to the lower end of the tubing 30 while the plunger 38 is directly moved by the sucker rods 32 which, in turn, is moved by the up and down action of the polished rod 20 as the walking beam 14 is angularly displaced about its pivot by the pitman 12. The standing valve 40, which is affixed to the barrel 36, acts as a suction valve, while the traveling valve, which is contained in the plunger 38, acts as a discharge valve. These valves operate like check valves opening and closing during the alternating movement of the plunger 38. During the upward movement of the plunger 38, the standing valve 40 opens and fluid is drawn from the well into the barrel 36 through openings 42 in the casing 28. Also, during the upward movement of the plunger 38, the traveling valve closes and fluid contained in the tubing 30 above the plunger 38 is lifted to the surface at the wellhead 24. Then, during the downward movement of the plunger 38, the traveling valve opens and the standing valve 40 closes to allow new fluid to move up the tubing 30 and above the plunger 38.

As well known in the art, the most vital part of the pumping system shown in FIG. 1 is the rod string (i.e., the polished rod 20, sucker rods 32 and/or pony rods), since its trouble-free operation is critical to the performance of the whole system. According to conventional practice, the various rods are connected together one at a time at the surface of the well to form a complete mechanical interconnection between the horsehead 16 and the downhole pump 34. The assembly of the sucker rods, in particular, is a time consuming operation which involves screwing on each rod section and lowering the assembly by that rod length and then repeating the operation for the other sucker rods. When there is a problem requiring the removal of the downhole pump 34 or replacement of a broken sucker rod 32, the conventional system of FIG. 1 requires the disassembly and stacking of the 25-foot long sucker rod sections, and their reassembly after correction of the problem. The disassembly and reassembly operation can easily take many hours and, furthermore, it requires the use of a derrick type platform to lift, hold, unscrew and stack the sucker rod sections. In addition, with every assembly or disassembly of a sucker rod there is a risk of scratching or scoring the surface of the rod or an associated coupling thus exposing the underlying base metal, which is less resistant to corrosion and failure than its treated surface.

In practice, it is often required that one or more of the sucker rods or pony rods be replaced for a variety of reasons. For example, structural failures near the ends of sucker rods have often been observed in oil well installations. While many of these failures are the result of corrosion weakening the rod after scoring of its surface, other failures are attributable to the normal design and use of the rods. The ends of a sucker rod 32 or coupling 33 typically have a larger diameter than the remaining portions and, thus, the ends are more likely to rub on the walls of the tubing 30 during the pumping operation resulting in additional wear of their corrosion resistant surface. Eventually, the wearing may become so significant that the sucker rod and coupling have to be replaced.

Pony rods may also have to be replaced on occasion. The selection of the proper length of pony rods to complete the mechanical interconnection is often a trial and error process directed to properly positioning the plunger 38 so that it remains in the fluid being pumped and does not hit the bottom or the top of the pump 34. When all new rods are assembled in a well for the first time, there is often enough elongation or stretch that some of the pony rods may have to be removed or replaced with shorter ones after only a few days of operation.

Even where the sucker rods have not failed and the pony rods are of appropriate length, the rods may nevertheless have to be raised in order to repair another subsurface component. For example, the downhole pump 34 is usually checked, repaired or replaced on an annual basis. In some instances, the pump can be maintained when replacing broken rods. However, in other instances, the rods may last longer than the pump and yet have to be pulled up in order to work on the downhole pump. Regardless of the reason, the removal and reinsertion of sucker rods or pony rods not only requires significant manpower and equipment but it may also interrupt oil production at the well for one or more days.

Another problem with the use of sucker rods is the amount of power required to lift them on the upstroke. For example, in a well where the downhole pump is 6000 feet below the surface, there are usually about 240 sucker rods. The lift weight of the se rods alone will use up a considerable amount of the power from the power source 10. Furthermore, the large diameter of the sucker rods 32 leaves minimal space to the inner wall of the tubing 30 for the upward flow of the fluid being pumped. The couplings 33 present further restrictions to the regular flow of the fluid. In sum, the sucker rods 32 and associated couplings 33 are not conducive to the efficient use of power from the power source 10.

The prior art has made various attempts to solve or minimize one or more of the problems discussed above. One such attempt can be seen in U.S. Pat. No. 4,024,913 which discloses the use of a non-metallic round cable in the well casing to reduce the total weight on the power source. This approach, however, still requires the use of at least some sucker rods to keep the non-metallic cable fully stretched since it has a small specific gravity (i.e., relatively small mass) and, thus, is buoyant (i.e., tends to remain afloat) in oil. This approach also requires the use of a separate spoolable line, having a generally flat cross section, that passes through the packing assembly, and is connected to a continuously cycling winch to provide the upstroke for the downhole pump. These requirements limit the usefulness of this approach for commercial purposes.

Another attempt at solving some of the above problems can be seen at page 18 of the January–February 1995 issue of Well Servicing, which discusses the use of a ribbon of carbon fiber rods because of their corrosion resistant and spoolable properties. However, the carbon fiber ribbon requires the weight of many sections of steel sucker rods near the bottom of the well and, thus, it is merely used to lighten the total load on the power source, and does not totally substitute for the sucker rods.

A final example of a prior art attempt at using cable in place of sucker rods may be found at pages 76–80 of The Oil and Gas Journal dated Apr. 8, 1974. This attempt uses a helically wound cable of cold drawn steel wires having nylon insulation. As the specific gravity of this cable is only about half that of sucker rods, it has about 15% more stretch than, and is not nearly as stiff as, sucker rods. Consequently, this cable has to be kept in tension at all times and, in addition, a specially designed downhole pump must be used in conjunction with this cable. While a few companies have tested this cable in shallow wells, it has failed to gain acceptance in the industry because of its inherent limitations.

It can thus be seen that the prior art attempts at replacing the sucker rods with a more flexible mechanical interconnection have met only limited success. The failures of these attempts may be better understood with reference to certain physical properties of the various mechanical interconnections employed in these attempts. The term "stiffness" as used herein refers to the tendency of an object to resume its original shape after the release of a bending or other shape altering force. Sucker rods, which are made of steel, are inherently stiff. That is, if a side force, for example, is applied to a straight sucker rod to bend it to a point not exceeding the limits of its elasticity, the sucker rod would immediately straighten upon the release of this force. Similarly, the sucker rod would also resist bending when a compressive force is applied along its axis during the pumping operation.

Many of the prior art replacements for sucker rods used flexible cables which were designed for ease in winding on a reel or winch. However, these prior art cables characteristically had very little stiffness. In other words, if one of these cables were laid in a curved pattern on a smooth or nearly frictionless surface, for example, it would have no inherent tendency to assume any other configuration. Furthermore, these cables generally had a small specific gravity and were quite buoyant in oil. As a result, additional weights had to be used near the downhole pump 34 to keep the cable straight and to help force the plunger 38 in the downward direction. It was also necessary to use especially designed pumps to accommodate the stretch in the cable during the upward movement of the horsehead 16.

Another important property of the mechanical interconnection between the horsehead 16 and the downhole pump 34 is "torsional rigidity," which is used herein to refer to the resistance of an object to rotation about its longitudinal axis. Many of the cables used in the prior art were comprised of individual wires that were spirally or helically wound. These cables had a relatively high torsional rigidity to rotational forces in one direction, and a tendency to unwind when rotational forces were applied in the opposite direction. Other prior art cables were made using bundles of wires (sometimes with spiral or helical winding) and had a similar torsional rigidity in either direction. Both types of cables, however, suffered from a lack of stiffness which caused them to slump, buckle and/or coil when either rotational or compressive forces were applied to one of their ends while the other end was held stationary (as would be the case in an oil well installation). This slumping, buckling and/or coiling occurred even when the cable was used in a confined space such as the tubing 30 in FIG. 1.

The "stretch" is yet another property which must be considered in evaluating the mechanical interconnections of the prior art. This term is used herein to refer to the difference between (a) the length of a cable when it is hanging vertically from one end and is stressed by its own weight and the weight of the plunger 38 at the other end, and (b) its length in a unstressed state laying on a flat surface. The stretch of many of the prior art cables reached 15 percent or more and, in part, is responsible for the use of specially designed downhole pumps or reciprocating winches.

The term "stackout" is used in the industry and herein to refer to the difference between (a) the length, at the surface of the well, of a mechanical interconnection when it is confined in the tubing 30 and the lower end is allowed to rest on the bottom of the well with no forces applied to the upper end such that all compressive forces are a result of its own weight, and (b) its length when the upper end is lifted so that the lower end is hanging free in the tubing 30. Thus, stackout is an important factor in pumping efficiency. The stackout for ¾ inch nominal diameter sucker rods in a 6000 foot well has been found to be about 6 inches or 0.08%, and is the industry benchmark. Many prior art cables could not approach this benchmark because of their tendency to slump, buckle and/or coil under their own weight within the tubing 30.

In view of the shortcomings of the prior art, it is an object of the present invention to provide a mechanical interconnection between the horsehead 16 and the downhole pump 34, which is flexible enough to be wound on a reel and yet has enough stiffness that it can transmit a compressive force from the horsehead 16 to the plunger 38 in the downhole pump 34.

Another object of the present invention is to provide a mechanical interconnection between the horsehead 16 and the downhole pump 34, which has a sufficiently large specific gravity that it is not buoyant in the fluid being pumped and, thus, under normal conditions, would not require additional weighting to properly operate the downhole pump 34.

Yet another object of the present invention is to reduce the downtime of an oil well installation due to any failure of the mechanical interconnection between the horsehead 16 and the downhole pump 34.

A further object of the present invention is to reduce the time required to retrieve and repair the downhole pump 34.

Other objects and advantages of the present invention will be apparent from a reading of the specification and the appended claims.

SUMMARY OF THE INVENTION

The present invention achieves the foregoing objects and advantages by replacing conventional sucker rods, pony rods and even polished rods with a single cable manufactured from a plurality of helically preformed wires that are assembled into a central wire core surrounded by the remaining wires. The assembled cable is heat treated to remove manufacturing stresses and to reduce any tendency of the assembled wires to untwist upon the application of compressive forces parallel to the central core wire. The heat treated cable is then impregnated with a polymer or epoxy to reduce any tendency for fretting among the assembled wires in the transition stage between tensile and compressive forces during the pumping cycle, and to further reduce any tendency of the assembled wires to untwist. The heat treated cable may also be coated with a polymer or epoxy for protection against corrosion and abrasion.

The design of the cable of the present invention imbues it with an inherent tendency to return to its manufactured state after the application of torsional forces, and allows it to be wound on a smaller diameter reel than possible with prior art steel cables. This design allows the operator of the oil well to easily transport with a single reel enough feet of cable to reach and pump fluid from the bottom of even a 15,000 foot well. Through the use of compression type fittings and retainers also constructed in accordance with the present invention, this cable can be connected directly between the downhole pump and the packing assembly at the wellhead, thus eliminating most, if not, all of the failure points of the prior art sucker-rod pumping system. The fitting at the lower (cut) end of the cable may also be filled with an epoxy type sealant compound to protect that cable end against corrosion, and to prevent its movement within the fitting.

Since the weight of the cable of the present invention is only a fraction of the weight of the rods it replaces, the energy savings for existing installations are considerable. Furthermore, in a new installation, the lighter load allows the use of a smaller and less expensive power source, thus resulting in additional cost savings. Since the cable can be easily lowered or raised using, for example, a winch mounted on a truck, the downhole pump can be inserted or retrieved in a fraction of the time previously required, and with substantially less manpower since much of the screwing and unscrewing operations associated with the use of the prior art rods are eliminated, along with the related storage and inventory problems. In addition, because the cable has a smaller diameter than the prior art rods and does not use any intermediate couplings, it provides very little resistance to fluid flow through the underground tubing. The elimination of oversized couplings, which are susceptible to corrosion, wear and damage, also reduces the risk of downtime due to coupling failures.

BRIEF DESCRIPTION OF THE DRAWINGS

The present invention will be better understood and its numerous objects and advantages will become apparent to those skilled in the art by reference to the following drawings in which.

DETAILED DESCRIPTION

Figure 2:
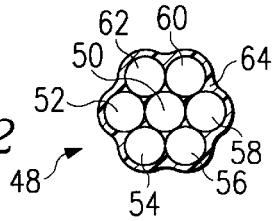
FIG. 2 is a cross sectional view of a cable constructed in accordance with the present invention for replacing conventional sucker rods.

Referring first to FIG. 2, the present invention provides a complete and effective substitute for sucker rods through the use of a cable 48 containing a plurality of helically preformed wires, including a central wire 50 surrounded, for example, by six additional wires 52–62, as shown in the cross sectional view of the cable 48 in FIG. 2. In a preferred embodiment, each of the wires 50–62 has a "lay" of 12 to 16 (i.e., a spiral completion of each of the helical strands every 12 to 16 times the diameter of the cable 48). After initial assembly of the preformed wires 50–62, the cable 48 is heat treated to relieve internal stresses from both the preforming process and the subsequent assembly. The cable 48 is now able to resist any tendency to unwind, buckle or coil due to the application of compressive or torsional forces. The cable 48 may be impregnated internally around the wires 50–62 and also covered externally with an epoxy, cross linked polymer or other suitable corrosion and abrasion resistant material 64. The application of a polymer to the internal and external areas of the cable 48 eliminates any air pockets in the cable 48, increases its specific gravity, and reinforces its resistance to the tendency to unwind, buckle or coil due to compressive or torsional forces.

The construction of the cable 48 as shown in FIG. 2, therefore, allows it to provide a stiff but flexible mechanical interconnection that is at least as strong and as resistant to a change in length between the application of compressive and tensile forces as the sucker rods it replaces. Furthermore, the cable 48 has a smaller diameter than conventional sucker rods, is less resistant to fluid flow, and can be easily wound to or from a reel for respective retrieval from or insertion into an oil well. It is believed, for example, that a ½ inch diameter cable 48 constructed in accordance with the present invention will have a stackout and stretch equivalent to the industry benchmark for ¾ inch diameter sucker rods 32, while being sufficiently flexible and resilient to be wound on a winch for quick insertion or removal from the well.

Figure 1:
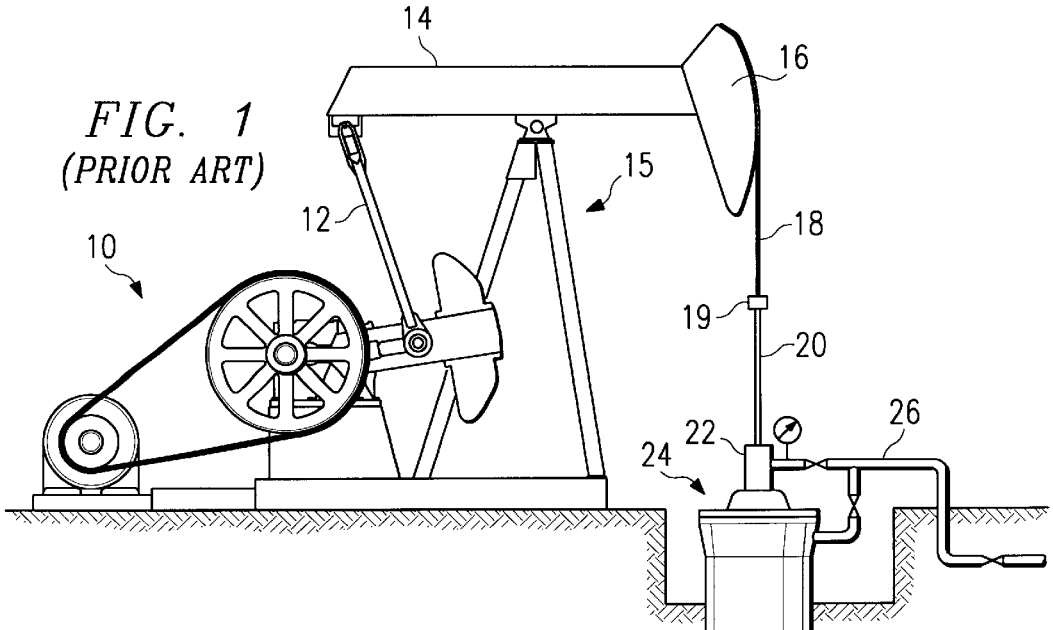
FIG. 1 (PRIOR ART)
FIG. 1 illustrates a conventional pumping system for an oil well installation including a packing assembly and a plurality of sucker rods connected to a downhole pump.
Figure 1:
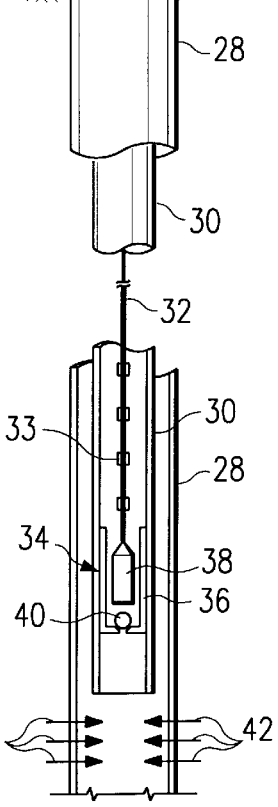
FIG. 1 (PRIOR ART)
Figure 3:
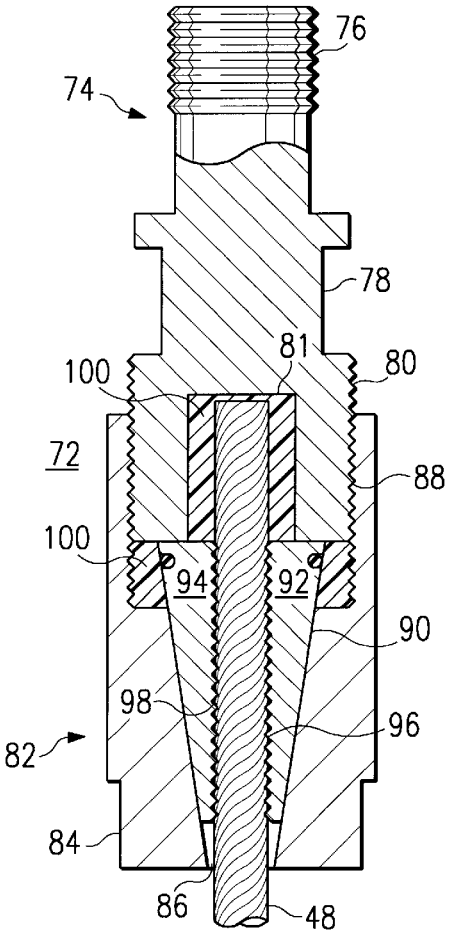
FIG. 3 is a cross sectional view of a screw type compression fitting applied to the end of the cable for interconnection to a coupling or other female line fitting on the downhole pump.

Referring next to FIG. 3, to attach the coated cable 48 of FIG. 2 to the downhole pump 34 of FIG. 1, one end of the cable 48 may be inserted into one end of a screw type compression fitting 72 which can matingly engage a coupling or other female line fitting on the pump 34. As can be seen from the cross sectional view of the fitting 72 in FIG. 3, the upper part of the fitting 72 comprises a rod pin 74 having threads 76, a flattened or wrench area 78, a male compression thread area 80, and an interior cavity 81 for receiving the cut end of the cable 48. The lower part of fitting 72 comprises a base or housing 82 having a flattened or wrench area 84, an opening 86 to allow passage of the cable 48 into the interior cavity 81, a female compression thread area 88 for engaging the male threaded area 80, and a cone surface 90 surrounding a plurality of wedge elements 92 and 94. The wedge elements 92 and 94 have a smooth outer surface for slidably engaging the cone surface 90, and a rough or serrated inner surface 96 and 98, respectively, for forcibly engaging the coated surface of the cable 48.

With continuing reference to FIG. 3, when the rod pin 74 is screwed into the base housing 82, the wedges 92 and 94 compress against the cone surface 90 and act to clamp the cable 48 inside the fitting 72 . In FIG. 3, the remaining voids in the interior cavity 81 are shown to have been filled with an epoxy compound 100. While this is not necessary in all applications of the present invention, the epoxy compound 100 provides further assurance that the rod pin 74 and the base housing 82 will not disengage during alternating cycles of tensile and compressive forces applied to the fitting 72 by the up and down movement of the cable 48. The epoxy compound 100 may also protect the cut end of the cable 48 in the interior cavity 81 from corrosion.

Figures 4, 5, 6:
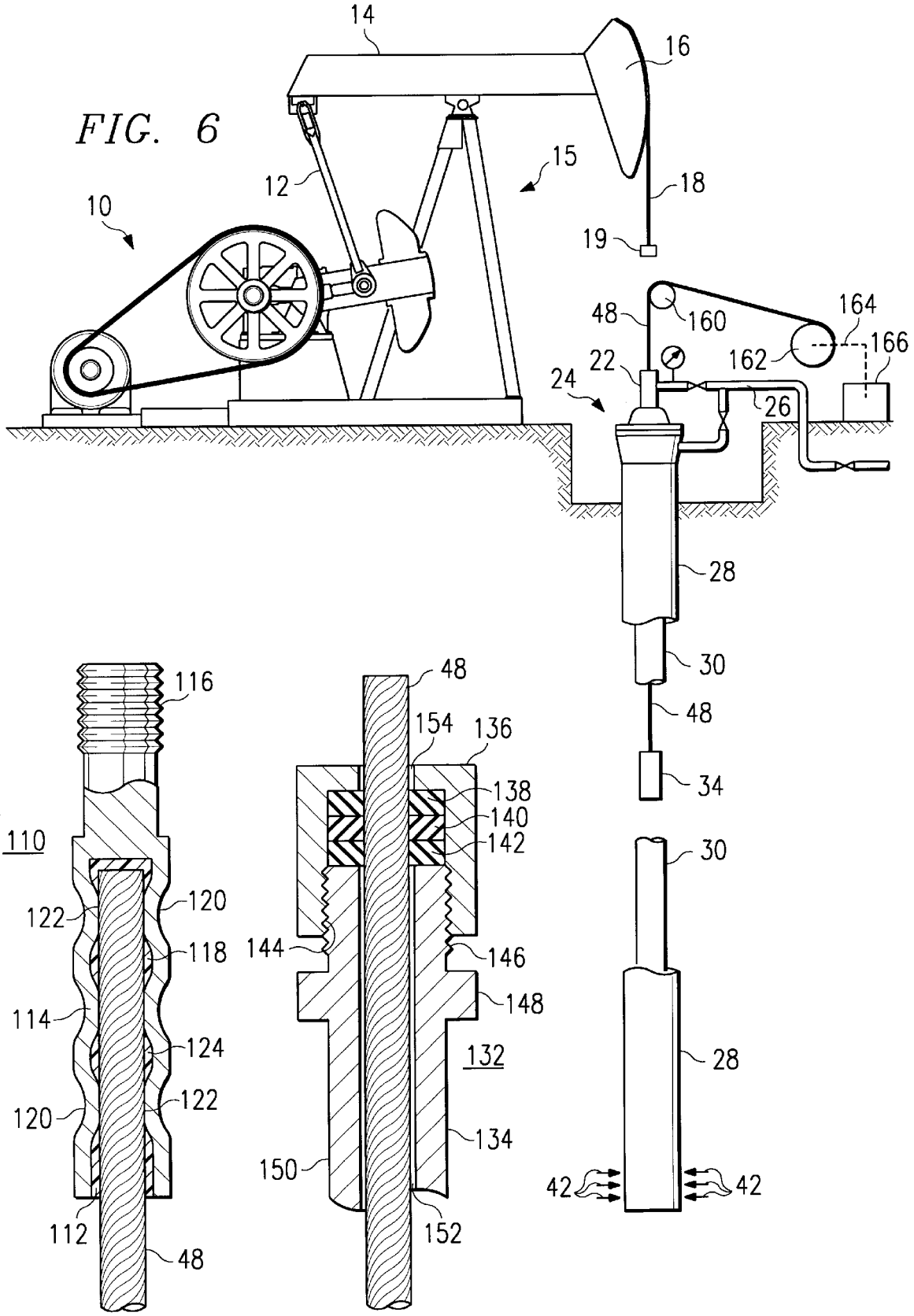
FIG. 4 is a cross sectional view of a mechanically compressed fitting which may be used instead of the screw type fitting of FIG. 3.
FIG. 5 is an exploded cross sectional view of a surface fluid retainer used in a packing assembly constructed in accordance with the present invention.
FIG. 6 illustrates the use of a winch to retrieve the cable and pump from the oil well installation of FIG. 1 as modified in accordance with the present invention.

It will be appreciated that the screw type compression fitting 72 shown in FIG. 3 represents only one example of how the coated cable 48 may be brought into engagement with the downhole pump 34. FIG. 4 shows a mechanical type compression fitting 110 which may also be used for this purpose. In FIG. 4, one end of the coated cable 48 is inserted into an opening 112 of the fitting 110 which has a base 114 and a threaded rod pin 116. The opening 112 leads to a cavity 118 in the base 114. The outer surface of the base 114 contains a plurality of indentations or dimples 120 (exaggerated for illustration purposes). The inner surface of the base 114 contains a plurality of protrusions 122 coinciding with the indentations 120. The protrusions 122 exert compressive forces against the surface of the coated cable 48 and secure the cable 48 inside the fitting 110. The indentations 120 and the corresponding protrusions 122 (which are exaggerated in FIG. 4 for purposes of clarity) may be formed with any of number of commercially available compression tools such as the Hydraulics Swedging Machines produced by National Corporation. As before, the remaining voids in the cavity 118 may be filled with an epoxy compound 124, if desired.

Referring next to FIG. 5, there is shown a surface fluid retainer 132 which is constructed in accordance with the present invention and which may be used in the packing assembly 22 of the pumping system shown in FIG. 1. In FIG. 5, the coated cable 48 passes through the center of the retainer 132 and down into the wellhead 24 of FIG. 1. The retainer 132 comprises a body 134, a compression cap 136 and a plurality of packing washers 138–142 mounted inside the cap 136. Although three identical washers 138–142 are illustratively shown in FIG. 5, it should be understood that the composition and number of washers will vary in accordance with the fluid pressures encountered by, and the forces applied to, the retainer 132. In one embodiment of the retainer 132, the upper and lower washers 138 and 142 are made of stainless steel so as to assure proper compression of the middle washer 140. The inner surface of the cap 136 has female threads 144 for engagement with male threads 146 on the upper end of the body 134. As can be seen from FIG. 5, the upper portion of the body 134 incorporates a flattened shoulder 148 which can be held by a wrench while the cap 136 is tightened to compress the washers 138–142 so as to clamp the retainer 132 against the cable 48. The lower portion of the body 134 has a polished surface 150 which slidably engages the seals (not shown) of the packing assembly 22 when the cable 48 is subjected to the reciprocating pumping motion, in a manner similar to the polished rod 20 shown in FIG. 1.

The retainer 132 of the present invention is designed to allow for easy readjustment of its position along the longitudinal axis of the cable 48 by temporarily unscrewing the cap 136, releasing the compressive forces provided by washers 138–142 against the surface of the cable 48, moving the retainer 132 up or down as needed, and rescrewing the cap 136. As will be apparent to persons of ordinary skill in the art, the normal axial load forces provided by the retainer 132 on the cable 48 are substantially less than the forces exerted by the washers 138–142 when compressed and, thus, the retainer 132 can be easily moved when the cap 136 is unscrewed. It will be readily appreciated that the cable 48 should be threaded through the retainer 132 before being attached to the horsehead 16 in FIG. 1. Specifically, the cable 48 would be passed through a central opening 152 of the body 134, the hollow centers of washers 138–142, and a central opening 154 in the cap 136. It will also be appreciated that this arrangement substitutes for the pony rods (and even the polished rod 20) discussed in connection with FIG. 1, and serves a similar function, since the cable 48 can be cut to any length and the position of the retainer 132 adjusted (before the addition of epoxy, if desired) until the proper length is obtained (at which time the epoxy may be added). This arrangement also minimize stresses on the packing assembly 22 in those situations where the horsehead 16 and the associated wireline hanger 18 are not properly aligned with the center of the wellhead 24.

Referring next to FIG. 6, the cable of the present invention and the downhole pump to which it connects can be easily raised using a winch or a similar motor-driven hoisting machine. In FIG. 6, the cable 48 has been disconnected from the wireline hanger 18 and associated coupling 19, and is being wound over a pulley 160 and onto a reel 162 rotated by an arm 164 that is driven by a motor 166. The pulley 160 is used to prevent undue bending of the cable 48 or abrasive wear of the coating on its surface. While not specifically shown in FIG. 6, the lower end of the cable 48 connects to the pump 34 through, for example, one of the fittings in FIGS. 3–4. As well known in the art, the pump 34 may be seated in a lower section of the tubing 30 and its up and down movement limited to this seating section. It will be appreciated that the weight of the mechanical interconnection between the horsehead 16 and the pump 34 provided by the cable 48 generates a compressive force which is sufficient for limiting the movement of the pump 34 to the seating section. Furthermore, the tensile force during the pumping operation will not accidentally unseat the pump 34 if the length of the cable 48 is properly adjusted. On the other hand, the pump 34 can be readily unseated and raised to the surface for repair or maintenance by applying a larger than normal upward force to the cable 48 using the motor 166. The pump 34 can then be passed through the wellhead 24 and onto the surface after removal of the packing assembly 22.

While the system of the present invention has been described in the context of an oil well installation, it can be equally applied in other fluid pumping installations requiring the application of opposite cyclical forces on a pump valve (plunger) to draw a fluid such as salt water, etc. The present invention may also be used in gas wells where fluids need to be removed from near the bottom of the well to better permit the introduction of the gas into the tubing for transmission to the surface.

In general, those skilled in the art will readily recognize that many modifications and variations may be made to the embodiments of the present invention disclosed herein without substantially departing from the spirit and scope of the present invention. Accordingly, the form of the invention disclosed herein is exemplary, and is not intended as a limitation on the scope of the invention as defined in the following claims.

We claim:

1. A fluid pumping system comprising:

a conduit extending from a surface location to a subsurface location containing a fluid to be pumped;

at least one opening in said conduit at said subsurface location for allowing the passage of said fluid into said conduit;

a pump situated in said conduit for pumping said fluid from said subsurface location to said surface location;

a power source situated at said surface location for cyclically moving said pump upwards and downwards through said conduit, said fluid being pumped to said surface location during the upward movements of said pump; and a cable connecting said power source to said pump, said cable being assembled from a plurality of helically preformed wires and being heat treated after assembly thereby making it resistant to torsional and compressive forces applied to it during the upward and downward movements of said pump, respectively.

2. The system of claim 1 wherein said cable is coated with a corrosion or abrasion resistant material.

3. The system of claim 1 wherein said cable is impregnated with a cross-linked polymer material around said wires.

4. The system of claim 1 wherein said fluid comprises oil.

5. A pump system comprising:

means for passing a fluid from an underground location to a surface location;

means positioned in said passing means for pumping said fluid to said surface;

means for driving said pumping means in cyclical movements between opposite ends of said passing means; and a cable for connecting said driving means to said pumping means, said cable including a plurality of heat treated helically preformed wires coated with a polymer material.

6. The pump system of claim 5 wherein said passing means comprises a conduit.

7. The pump system of claim 5 wherein said pumping means comprises a plunger including a one-way valve.

8. The pump system of claim 5 wherein said cable connects to said pumping means through a compression fitting means.

9. The pump system of claim 5 wherein said cable connects to said driving means through a fluid retainer means.

10. A system for interconnecting a reciprocating power source at the surface of a fluid pumping well with a one-way pump valve submerged in the fluid being pumped from the bottom of the well, the system comprising:

a cable assembled from a plurality of helically preformed wire elements that are arranged around a central axis of said cable, the assembled cable being heat treated to remove preforming and assembly stresses; and a pair of mechanical connectors including a first connector for connecting one end of said cable to the reciprocating power source, and a second connector for connecting the other end of said cable to said one-way pump valve.

11. The system of claim 10 wherein said cable is coated with a corrosion or abrasion resistant material.

12. The system of claim 10 wherein a corrosion resistant coating is applied to the surface of the wire elements in said cable to increase the stiffness of said cable.

13. The system of claim 10 wherein said first connector comprises a fluid retainer positioned inside a packing assembly at the wellhead.

14. The system of claim 10 wherein said second connector comprises a compression fitting impregnated with an epoxy compound to protect the associated cable end from contact with the fluid being pumped.

15. The system of claim 10 wherein at least one of said first and second connectors is impregnated with an epoxy sealant to prevent movement of said cable in said connector.

16. The system of claim 10 wherein the fluid being pumped comprises oil.

17. A compression type fitting for securing a cable to a downhole pump in a fluid pumping system, one end of the fitting comprising a connector means for coupling said fitting with said downhole pump; the other end of the fitting having a cavity for receiving a cut end of said cable, the walls of said cavity being bent at selected locations so as to compressively hold said cable in said cavity; and with any remaining voids in said cavity being filled with epoxy so as to mechanically restrain said cable from moving within said cavity.

18. The compression type fitting of claim 17 wherein said connector means comprises a threaded rod pin.

* * * * *